US006947009B2

(12) United States Patent
Kim et al.

(10) Patent No.: US 6,947,009 B2
(45) Date of Patent: Sep. 20, 2005

(54) BUILT-IN ANTENNA SYSTEM FOR INDOOR WIRELESS COMMUNICATIONS

(75) Inventors: Ki-ho Kim, Seoul (KR); Young-eil Kim, Suwon (KR); Do-hoon Kwon, Seoul (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 13 days.

(21) Appl. No.: 10/684,577

(22) Filed: Oct. 15, 2003

(65) Prior Publication Data

US 2004/0125024 A1 Jul. 1, 2004

(30) Foreign Application Priority Data

Oct. 15, 2002 (KR) ..... 10-2002-0062921

(51) Int. Cl.[7] ..... H01Q 21/00

(52) U.S. Cl. ..... 343/893; 343/700 MS; 343/786

(58) Field of Search ..... 343/700 MS, 702, 343/786, 853, 893

(56) References Cited

U.S. PATENT DOCUMENTS 5,963,846 A * 10/1999 Kurby ..... 455/12.1
6,160,514 A * 12/2000 Judd ..... 343/700 MS
6,163,299 A * 12/2000 Park ..... 343/700 MS
6,421,027 B1 * 7/2002 Takatori et al. ..... 343/893
6,448,930 B1 9/2002 Judd ..... 343/700
6,501,436 B1 * 12/2002 Saito et al. ..... 343/867
6,563,465 B2 * 5/2003 Frecska ..... 343/700 MS
2002/0080087 A1 6/2002 Takatori ..... 343/893

FOREIGN PATENT DOCUMENTS

EP 1071160 1/2001
JP 8-125433 5/1996

* cited by examiner

*Primary Examiner*—Tan Ho
(74) *Attorney, Agent, or Firm*—Lee & Morse P.C.

(57) ABSTRACT

A built-in antenna system for indoor wireless communications includes an AP antenna, all of the surfaces of which, except for an emitting surface, are installed behind wall surfaces in a wall of a building, and includes an access point (AP) (or an RF unit) connected to the AP antenna. Alternatively, the antenna system includes an antenna structure that is installed to pass through a selected wall of a building and an AP (or RF unit) connected to the antenna structure, the antenna structure having a sliding structure that can be adjusted according to the thickness of the wall. The shift of a frequency band caused by the wall may be avoided, and high-quality wireless communications is achieved regardless of the location of a wireless communication terminal in the building. Further, it is possible to increase the intensity of an electric field at the position of the terminal.

19 Claims, 5 Drawing Sheets

BUILT-IN ANTENNA SYSTEM FOR INDOOR WIRELESS COMMUNICATIONS

BACKGROUND OF THE INVENTION

1. Field of the Invention

The present invention relates to a wireless communication antenna system, and more particularly, to a built-in antenna system for indoor wireless communications.

2. Description of the Related Art

The use of wireless communication appliances having high mobility, such as a web pad, has become quite popular due to advances in home networks. Accordingly, much attention has been directed to improve the performance of a built-in antenna in order to increase the quality of wireless communications.

Generally, indoor wireless communications are performed mainly between an access point (AP) of a wireless local area network (LAN), which has low or no mobility, and a notebook computer. For this reason, low attention has been paid to indoor wireless communications.

The quality of indoor wireless communications is closely related to the indoor wireless environments. Therefore, the indoor wireless environments need to be first considered before addressing factors to increase the quality of indoor wireless communications.

The indoor wireless environments may depend on the type of architectural or residence style, that is, they may vary from country to country or region to region. For instance, the physical structure of houses constructed with non-metallic materials, such as sheet rock or plaster boards, do not block electric (or radio) waves. Accordingly, indoor wireless communications are not likely to be affected by the shape or location of an antenna.

In contrast, apartments, made with steel reinforcements or steel frame structures, block the propagation of electric (or radio) waves. Therefore, the quality of wireless communications depends on the shape or location of an antenna.

Referring to FIG. 1, in a conventional indoor wireless communication system, an AP 12 and an antenna 12*a* for the AP 12 are combined together and installed on one surface of a wall 10. Thus, a signal transmitted from the antenna 12*a* is propagated only in one direction due to the wall 10. In this case, the signal is successfully transmitted to a first wireless communication terminal 14 which is installed on a line of sight of the antenna 12*a*. However, the signal may be weakened or may not be transmitted to the second terminal 16 during the transmission of the signal to a second wireless communication terminal 16 located behind the wall 10. Also, the presence of the wall 10 causes a shift in a frequency band of the antenna 12*a*.

In general, the antenna 12*a* is installed in a living room and a beam pattern transmitted from the antenna 12*a* has a single directionality, when the system of FIG. 1 is used in an apartment unit. Thus, it is possible to stably conduct wireless communications in the living room but the speed of communication may be reduced or communications may be impossible in other rooms of the apartment unit.

The installment of several APs in an apartment unit reduces the occurrence of the aforementioned problem in a wireless communication adopting a wireless communication appliance of low mobility. However, interferences of electric (or radio) waves is still a serious problem in a wireless communication adopting a wireless communication appliance of high mobility.

As mentioned above, a conventional antenna system for indoor wireless communications is capable of supporting high-quality wireless communications for a wireless communication terminal that is installed on a line of sight of an antenna for an AP. However, with the conventional antenna system, it is difficult to support high quality wireless communications for a wireless communication terminal that deviates from the line of sight of an AP antenna, for example, when there is a wall between the terminal and the AP antenna. In a worst case scenario, wireless communications cannot be conducted with the wireless communication terminal using the conventional antenna system. In particular, a frequency band of the antenna for an AP is more likely to shift when the AP antenna is installed adjacent to a wall.

SUMMARY OF THE INVENTION

The present invention provides a built-in antenna system for indoor wireless communications which can support high-quality wireless communications regardless of the location of a wireless communication terminal.

According to a feature of a first embodiment of the present invention, there is provided an antenna system for indoor wireless communications, comprising a first access point (AP) antenna having a radio wave emitting surface, a part of the first AP antenna being installed behind a first wall surface of a wall in a building construction, an AP (RF unit) electrically connected to the first AP antenna, and a second AP antenna having a radio wave emitting surface, a part of the second AP antenna being installed behind a second wall surface of the wall, electrically connected to the AP (RF unit).

In accordance with a feature of the present invention, all of the surfaces of the first and second AP antennae, except their respective emitting surfaces, are installed behind their respective wall surfaces, the radio wave emitting surfaces of the first and second AP antennae being exposed and in parallel with their respective wall surfaces to maximize a radiation efficiency of radio waves emitted therefrom.

According to a feature of an alternate first embodiment, the antenna system of the present invention may further comprise a third AP antenna having a radio wave emitting surface, wherein the part of the first AP antenna is installed behind the first wall surface of the wall adjacent a protruding corner of the wall, a part of the third AP antenna is installed behind a third wall surface of the wall adjacent the protruding corner of the wall, the first wall surface and the third wall surface forming an angle at the protruding corner of the wall, to enable wireless communications in an area of the building construction which is not on a line of sight with the second AP antenna. All of the surfaces of the third AP antenna, except its radio wave emitting surface, are installed behind the third wall surface of the wall, the radio wave emitting surface of the third AP antenna being exposed and in parallel with the third wall surface of the wall.

In the alternate first embodiment, the second AP antenna may be removed if the second wall surface is an exterior wall surface of the building.

In the first embodiment of the present invention, the first AP antenna and the AP may be installed behind the first wall surface of the first wall. Moreover, the AP and the first and second AP antennae may be combined and installed behind the first wall surface and the second wall surface, respectively, in the wall. In the alternate first embodiment, the first, second and third AP antennae and the AP may be combined and installed behind the first wall surface, second wall surface and third wall surface, respectively, in the wall.

According to another feature of the first embodiment of the present invention, a power divider may be installed in the wall between the first and second AP antenna and the AP, the power divider providing a signal received from the AP to the first and second AP antennae, respectively.

According to another feature of the alternate first embodiment of the present invention, a power divider may be installed in the wall between the first through third AP antenna and the AP, the power divider providing a signal received from the AP to the first through third AP antennae, respectively. Alternatively, in the alternate first embodiment of the present invention, the power divider may be installed in the wall between the first and third AP antenna and the AP, the power divider providing a signal received from the AP to the first and third AP antennae, respectively. Alternatively, the first AP antenna and the AP may be combined and installed in the wall.

According to a second embodiment of the present invention, there is an antenna system for indoor wireless communications, comprising a first antenna structure that is installed to pass through a selected wall having a thickness in a building construction, the first antenna structure having a sliding structure that may be adjusted according to the thickness of the wall; and an AP (RF unit) connected to the first antenna structure. The first antenna structure comprises first and second horn antennae which are exposed at both sides of the wall and parallel with the wall, a feed that transmits a signal received from the AP to the first and second horn antennae; and a sliding waveguide wall that connects the first and second horn antennae and the feed in a sliding structure to match the thickness of the wall. The AP may be connected to the feed through the wall.

The selected wall may further comprise a first wall surface and a second wall surface, the first wall surface having the first antenna structure installed therein and the second wall surface being perpendicular to the first wall surface. Moreover, according to the second embodiment of the present invention, a second antenna structure may be installed in the second wall surface, the second antenna structure having the same structure as the first antenna structure.

Accordingly, an antenna system according to the present invention minimizes the shift of a frequency band of an antenna for an AP, due to the presence of a wall, and supports high-quality wireless communications regardless of the position of a wireless communication terminal. Further, it is possible to maintain the intensity of an electric field where the terminal is installed.

BRIEF DESCRIPTION OF THE DRAWINGS

The above and other features and advantages of the present invention will become more apparent to those of ordinary skill in the art by describing in detail preferred embodiments thereof with reference to the attached drawings in which.

DETAILED DESCRIPTION OF THE INVENTION

Figure 1:
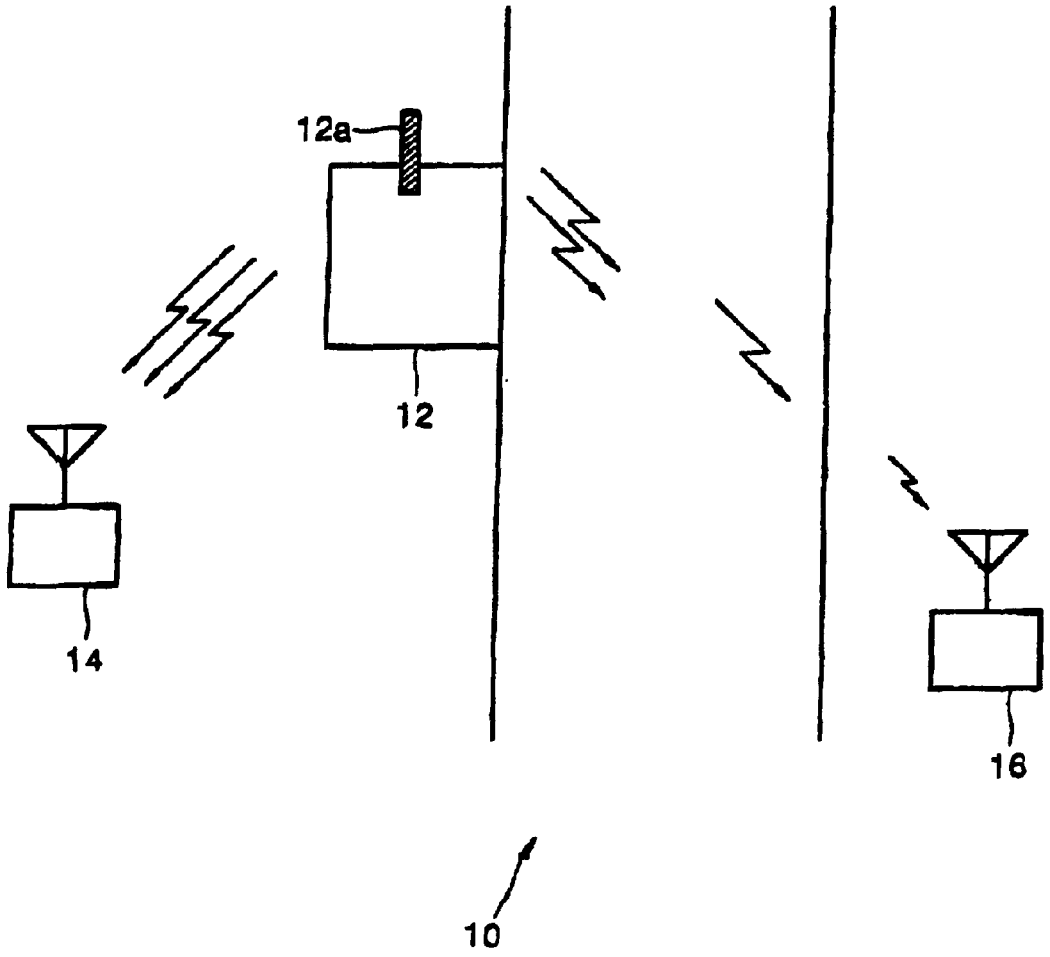
FIG. 1 (PRIOR ART)
FIG. 1 is a schematic diagram illustrating a conventional antenna system for indoor wireless communications.

Korean Patent Application No. 2002-62921 filed Oct. 15, 2002, and entitled: "Built-in Antenna System for Indoor Wireless Communications," is incorporated by reference herein in its entirety.

Hereinafter, preferred embodiments of a built-in antenna system for indoor wireless communications according to the present invention will be explained in detail with reference to the accompanying drawings. In the drawings, the thickness of layers and regions are exaggerated for clarity.

Figure 2:
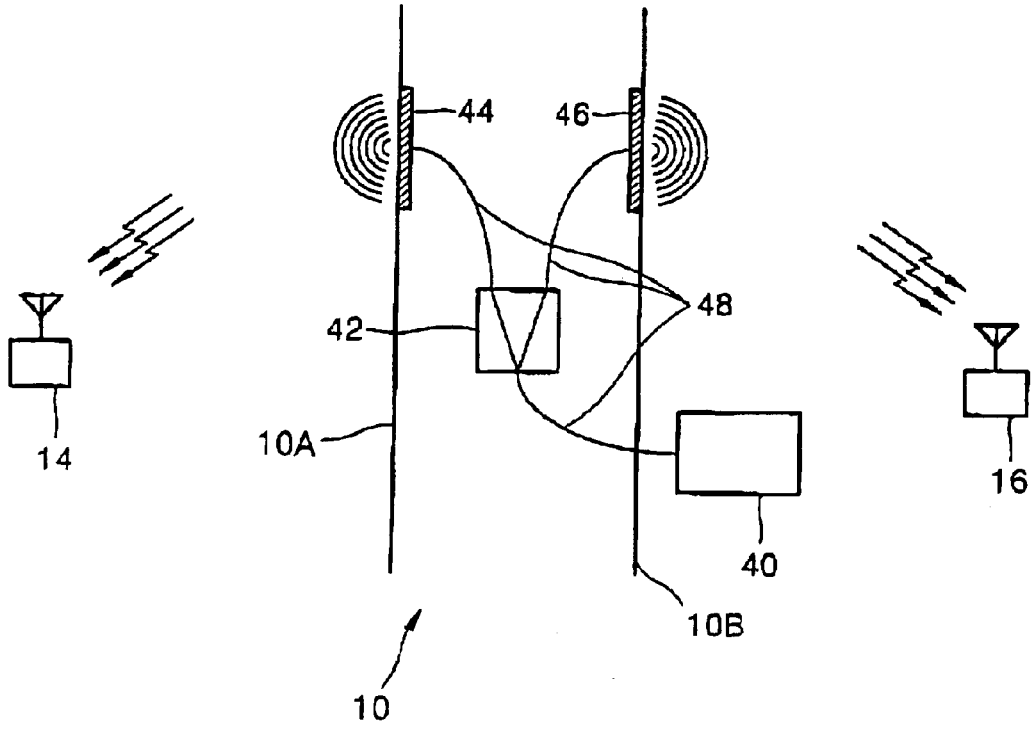
FIG. 2 is a schematic diagram illustrating a built-in antenna system for indoor wireless communications according to a preferred embodiment of the present invention.

First Embodiment:

Referring to FIG. 2, a built-in antenna system for indoor wireless communications, according to a first embodiment of the present invention, includes a first access point (AP) antenna 44 and a second AP antenna 46 which are installed behind opposite surfaces of a wall 10 in a building construction. A first AP 40, i.e., a radio-frequency (RF) unit is installed outside of the wall 10 and physically separated from the first and second AP antennae 44 and 46, and is electrically connected to the first and second AP antennae 44 and 46. An optional first power divider 42 may be located within the wall 10, and is electrically connected between the first AP 40 and the first and second AP antennae 44 and 46. The first power divider 42 divides or splits a signal transmitted from the first AP 40 into two relatively equal parts or signals and provides them to the first and second AP antennae 44 and 46. The first AP 40 and the first power divider 42, and the first power divider 42 and the first and second AP antennae 44 and 46 are connected to one another, using a first RF cable 48.

More specifically, all of the surfaces of the first AP antenna 44, except for the radio wave emitting surface, are installed behind a first wall surface 10A of the wall 10 which faces an area in which a first wireless communication terminal 14 is used. It is preferable that the first AP antenna 44 is installed to maximize the radiation efficiency of a radio wave, for example, it may be installed such that the radio wave emitting surface is parallel with the first wall surface 10A of the wall 10. The second AP antenna 46 may be installed behind a second wall surface 10B of the wall 10 facing an area in which a second wireless communication terminal 16 is used. It is preferable that the second AP antenna 46 is installed in the same manner in which the first AP antenna 44 is installed, i.e., the radio wave emitting surface of the second AP antenna 46 is parallel with the second wall surface 10B of the wall 10.

The first AP antenna 44 receives a signal from the first AP 40, sends it to the first terminal 14 installed in a line of sight of the first AP antenna 44, and emits a signal output from the first terminal 14 to the first AP 40. The second AP antenna 46 receives a signal output from the second terminal 16, transmits it to the first AP 40, and emits a signal received from the first AP 40 to the second terminal 16.

In the case of a house or a building with rooms, either the first or second AP antennae 44 or 46 may be omitted from the built-in antenna system of FIG. 2. If the first or second AP antennae 44 or 46 is omitted, the first power divider 42 is not required because a selected one of the AP antennae 44 and 46 is directly connected to the first AP 40 through the wall 10.

Alternatively, the built-in antenna system of FIG. 2 may be manufactured such that the first and second AP antennae 44 and 46 and the first AP 40 are combined and built within the wall 10. Further, even in a house or a building with a room, one of the first and second AP antennae 44 and 46 may be combined with the first AP 40 and installed behind a wall of the house or the building. If the first AP 40 and the AP antenna 44 or 46, which is connected to the first AP 40, are combined, the first power divider 42 is not required.

Figure 4:
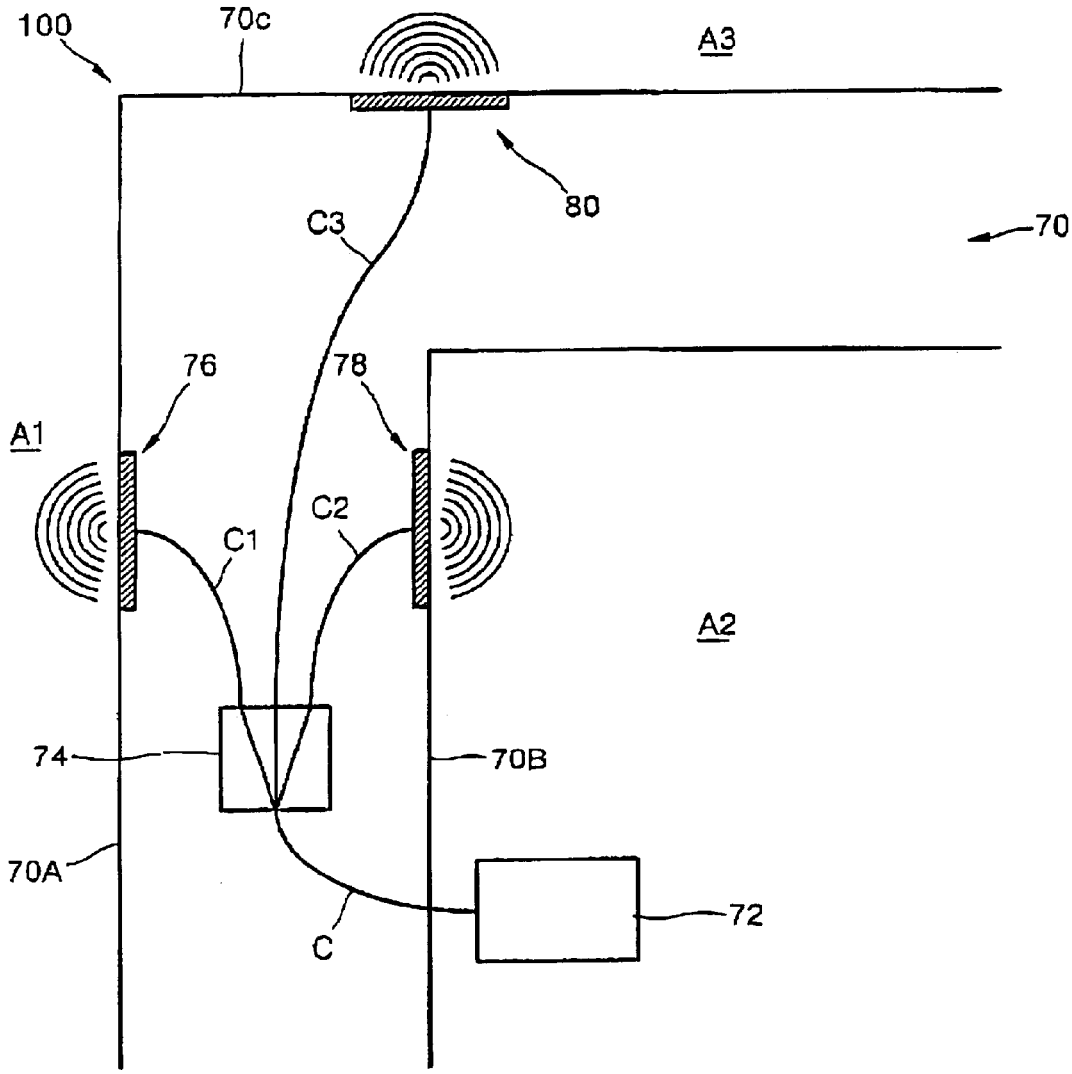
FIG. 4 is a schematic diagram of the built-in antenna system illustrated in FIG. 2 which is adapted for and installed in a protruding corner.

The wall 10 illustrated in FIG. 2 is shown having only a straight structure and has no corners. Accordingly, only two areas of the inside of a construction facing the opposing surfaces 10A and 10B of the wall 10 need to be considered and covered for wireless communications. However, in the case of a wall 70 having a corner 100, as shown in FIG. 4, first through third areas A1, A2, and A3 surrounding the wall 70 inside the building construction must be considered and covered for effective wireless communications. Accordingly, a configuration of a structure of a built-in antenna system according to an alternate first embodiment must be different from that of the built-in antenna system illustrated in FIG. 2.

Alternate First Embodiment:

Referring to FIG. 4, an alternate first embodiment will now be described. A first AP antenna 76 is installed behind a first wall surface 70A of the wall 70 which faces the first area A1, to enable wireless communications in the first area A1. A second AP antenna 78 is installed behind a second wall surface 70B of the wall 70, which faces the second area A2, to enable wireless communications in the second area A2. With only the first and second AP antennae 76 and 78 in place, it is difficult for a radio wave to reach the third area A3 facing a third wall surface 70C of the wall 70 due to the corner 100 of the wall 70. Even if radio waves emitted from the first AP antenna 76 reach the third area A3, the intensity of the radio wave is feeble and unreliable to enable wireless communication. To solve this problem, a third AP antenna 80 is installed behind the third wall surface 70C of the wall 70 facing the third area A3 in order to enable wireless communications in the third area A3. It is preferable that the first, second and third AP antennae 76, 78, and 80 are installed in the same way in which the first and second AP antennae 44 and 46 of FIG. 2 are installed, i.e., the radio wave emitting surfaces of each of the AP antennae 76, 68 and 80 are parallel with their respective wall surfaces 70A, 70B and 70C. Thus, detailed descriptions on the installment of the first, second and third AP antennae 76, 78, and 80 in accordance with an alternate first embodiment of the present invention will not be repeated. In this alternate first embodiment of the present invention, the first, second and third AP antennae 76, 78, and 80 are connected to a first AP 72 outside the wall 70. The first AP 72 outside the wall 70 and the first, second and third AP antennae 76, 78, and 80 inside the wall 70 are electrically connected to one another using RF cables. A first power divider 74 may be located within the wall 70 between the first and second AP antennae 76 and 78. The first power divider 74 divides or splits a signal transmitted from the first AP 72 into three equal parts or signals and provides or transmits these signals to the first, second and third AP antennae 76, 78, and 80. The first power divider 74 and the first AP 72 are electrically connected to each other using a RF cable C, and the first power divider 74 is electrically connected to the first, second and third AP antennae 76, 78, and 80 using RF cables C1, C2, and C3, respectively.

Alternatively, the antenna system illustrated in FIG. 4 may be manufactured such that the first AP 72 and the first, second and third AP antennae 76, 78, and 80 are combined together and built within the wall 70. In such a case, the first power divider 74 is not required.

In a building configuration where the wall 70 of FIG. 4 encompasses a room within a house or a building unit with the first and third areas A1 and A3 constituting the inside of the room and the second area A2 constituting an area external to the house or building unit, the second AP antenna 78 is unnecessary since wireless communication in the second area A2 is unnecessary. However, although there is only one room, the wall 70 may have one or multiple corners 100 protruding toward the inside of the room. If an AP antenna is installed in such a room, a wireless communication terminal may not be positioned on a line of sight of the AP antenna, depending on the location of the terminal. In this case, the number of AP antennae needs to be increased depending on the shape of the wall 70 and the number of corners 100 as may be adapted by one of skill in the art based upon a description of the alternate first embodiment as set forth above.

Second Embodiment:

According a second embodiment of the present invention, a built-in antenna system is installed to pass radio waves through a wall.

Figure 3:
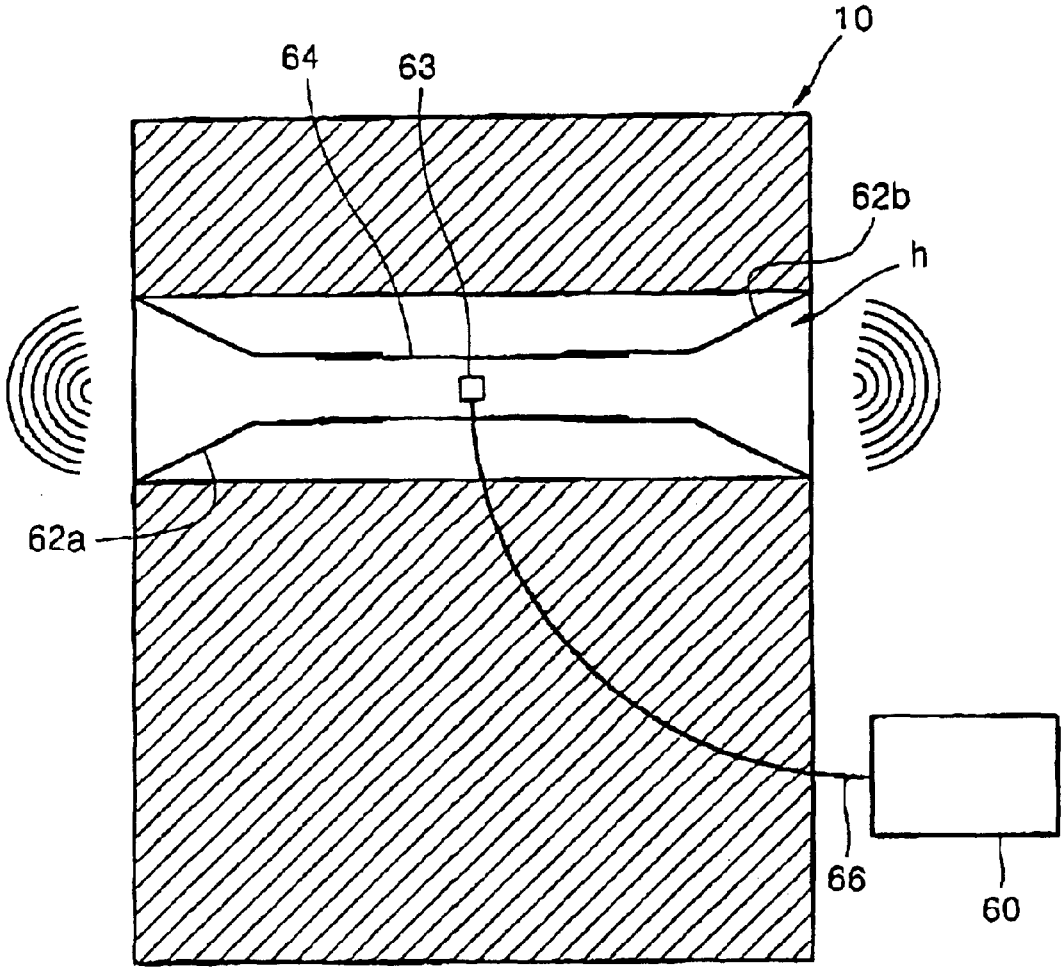
FIG. 3 is a schematic diagram illustrating a built-in antenna system for indoor wireless communications according to another embodiment of the present invention.

More specifically, referring to FIG. 3, a hole h is formed in a wall 10. Also, an antenna structure, which includes a first horn antenna 62*a*, a second horn antenna 62*b*, a feed 63, and a sliding waveguide wall 64, is installed in the hole h to emit a signal, which is transmitted from a first AP 60 located outside the wall 10, toward wireless communication terminals (not shown) that may be on either one or both sides of the wall 10. The first AP 60 located outside the wall 10 is connected to the antenna structure inside the wall 10 using a RF cable 66. The first and second horn antennae 62*a* and 62*b* are mounted at the ends of the hole h parallel with the wall 10, emit a signal transmitted from a feed 63 to wireless communications terminals (not shown) on either one or both sides of the wall 10, and send signals output from the terminals to the feed 63. The feed 63 provides the signal transmitted from the first AP 60 to the first and second horn antennae 62*a* and 62*b*. The sliding waveguide wall 64 connects the first and second horn antennae 62*a* and 62*b* to the feed 63 in a sliding structure. The first AP 60 is electrically connected to the feed 63.

Figure 5:
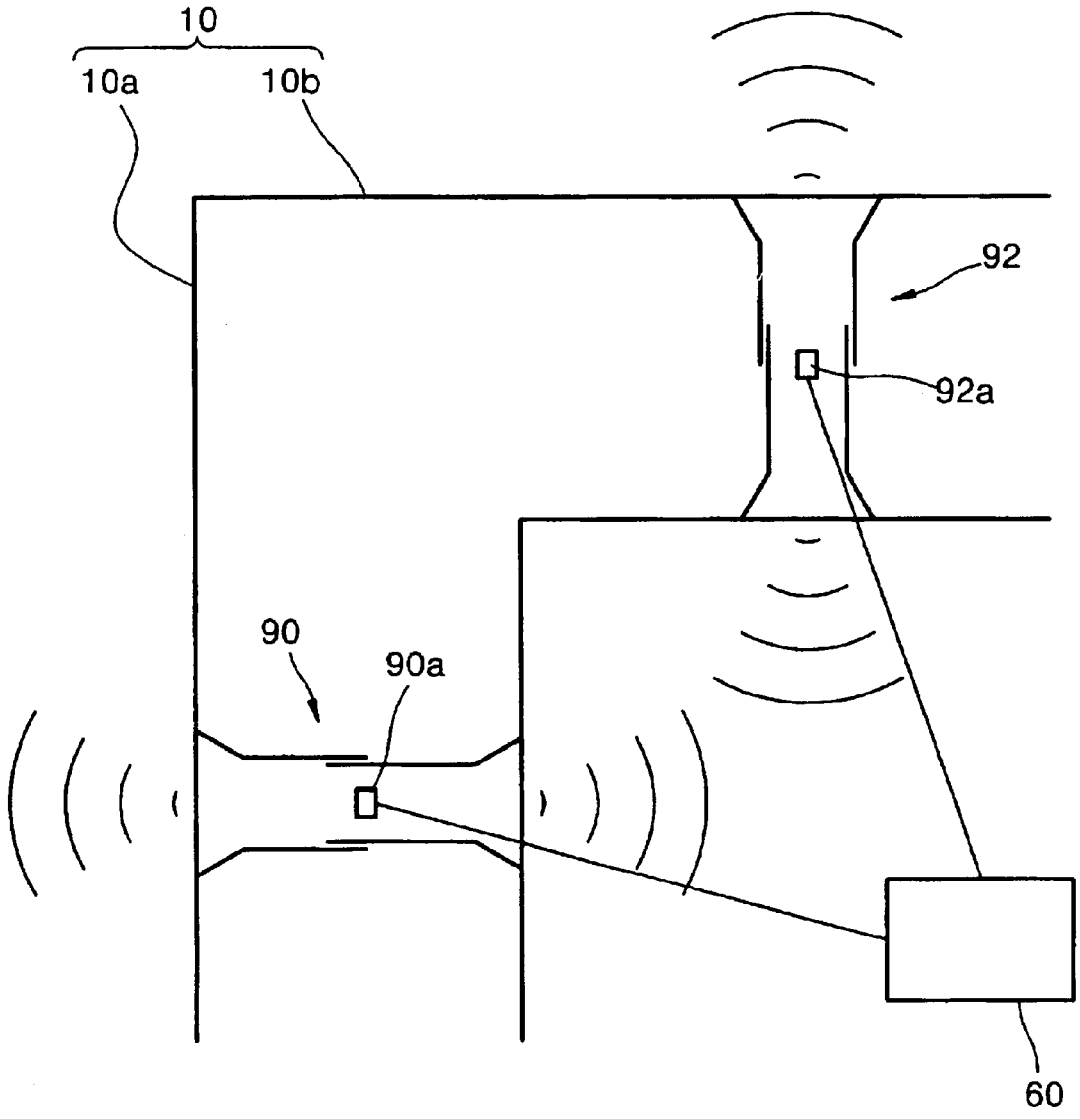
FIG. 5 is a plan, schematic diagram illustrating the built-in antenna system illustrated in FIG. 3 which is adapted for and installed in a protruding corner.

Referring to FIG. 5, the wall 10 may have a first wall surface 10*a* and a second wall surface 10*b* which are perpendicular to each other and form a corner of the wall 10. In this case, the antenna structure of FIG. 3 may be installed in both the first and second wall surfaces 10*a* and 10*b*, respectively, as shown in FIG. 5.

More specifically, a first antenna structure 90 and a second antenna structure 92 are installed behind the first and second wall surfaces 10*a* and 10*b* of the wall 10 to pass through the wall 10 of the first wall surface 10*a* and the wall 10 of the second wall surface 10*b*, respectively. The first and second antenna structures 90 and 92 have the same structures as the antenna structure illustrated in FIG. 3. A first feed 90*a* and a second feed 92*a* are installed in the first and second antenna structures 90 and 92, respectively. The first and second feeds 90*a* and 92*a* are electrically connected to the first AP 60 to provide a signal transmitted from the first AP 60 to the first and second antenna structures 90 and 92.

The inventors of the present invention have analyzed the intensity distribution of an electric field using ray analysis in order to verify the effects of the present invention. In the analysis, the performances of non-directional dipole antennae installed on a surface of and in the wall were respectively investigated. The investigation was accomplished at a frequency band of 2.44 GHz. Results of investigation conducted at a frequency band of 5 GHz were the same as results of investigation conducted at the frequency band of 2.44 GHz.

The analysis result will now be described without reference to any drawing figures. First, when the non-directional dipole antenna was installed on the surface of the wall, a signal emitted from the dipole antenna was intercepted by the wall and did not propagate. The intensity distribution of an electric field of the signal transmitted from the non-directional dipole antenna when it was installed behind the wall was more than 25 dB higher than that of the non-directional dipole installed on the surface of the wall.

As described above, in a built-in antenna system according to the present invention, antennae are installed behind the surfaces of a wall with their radio wave emitting surface exposed and facing areas of a room or building construction in which terminals for indoor wireless communications are placed. The antennae are installed behind the surfaces of a wall such that the radio wave emitting surfaces of each antennae are parallel with the surface of the wall within which they are respectively installed. Thus, the terminals can be located on lines of sight of the antennae irrespective of the location of the terminals in the room or building construction. Accordingly, the intensity of an electric field of a signal transmitted from the antennae is higher than that of a conventional antenna system, thereby improving the built-in quality of wireless communications. Further, it is possible to minimize the shift of a frequency band caused by the presence of a wall.

While this invention has been particularly shown and described with reference to preferred embodiments thereof, it will be understood by those skilled in the art that various changes in form and details may be made therein without departing from the spirit and scope of the invention as defined by the appended claims. For instance, those skilled in the art may use a divider, instead of the power divider shown in FIG. 2 or 4, which divides a signal received from an AP into unequal parts to correspond to the characteristics of AP antennae. Also, a selected one of horn antennae may be omitted when a wireless communication terminal is installed toward only one surface of a wall in which a built-in antenna system, according to the second embodiment of the present invention as shown in FIG. 3, is installed. Otherwise, the AP antennae are partly installed in a wall.

What is claimed is:

1. An antenna system for indoor wireless communications, comprising:

a first access point (AP) antenna having a radio wave emitting surface, a part of the first AP antenna being installed behind a first wall surface of a wall in a building construction;

an AP (RF unit) electrically connected to the first AP antenna; and a second AP antenna having a radio wave emitting surface, a part of the second AP antenna being installed behind a second wall surface of the wall, electrically connected to the AP (RF unit).

2. The antenna system as claimed in claim 1, wherein all of the surfaces of the first and second AP antennae, except their respective emitting surfaces, are installed behind their respective wall surfaces, the radio wave emitting surfaces of the first and second AP antennae being exposed and in parallel with their respective wall surfaces to maximize a radiation efficiency of radio waves emitted therefrom.

3. The antenna system as claimed in claim 1, further comprising a third AP antenna having a radio wave emitting surface, wherein the part of the first AP antenna is installed behind the first wall surface of the wall adjacent a protruding corner of the wall, a part of the third AP antenna is installed behind a third wall surface of the wall adjacent the protruding corner of the wall, the first wall surface and the third wall surface forming an angle at the protruding corner of the wall, to enable wireless communications in an area of the building construction which is not on a line of sight with the second AP antenna.

4. The antenna system as claimed in claim 3, wherein all of the surfaces of the third AP antenna, except its radio wave emitting surface, are installed behind the third wall surface of the wall, the radio wave emitting surface of the third AP antenna being exposed and in parallel with the third wall surface of the wall.

5. The antenna system as claimed in claim 3, wherein the first, second and third AP antennae and the AP are combined and installed behind the first wall surface, second wall surface and third wall surface, respectively, in the wall.

6. The antenna system as claimed in claim 3, further comprising a power divider installed in the wall between the first through third AP antenna and the AP, the power divider providing a signal received from the AP to the first through third AP antennae, respectively.

7. The antenna system as claimed in claim 1, wherein the first AP antenna and the AP are installed behind the first wall surface of the first wall.

8. The antenna system as claimed in claim 1, wherein the AP and the first and second AP antennae are combined and installed behind the first wall surface and the second wall surface, respectively, in the wall.

9. The antenna system as claimed in claim 1, further comprising a power divider installed in the wall between the first and second AP antenna and the AP, the power divider providing a signal received from the AP to the first and second AP antennae, respectively.

10. The antenna system as claimed in claim 1, wherein the part of the first AP antenna is installed behind the first wall surface of the wall adjacent a protruding corner of the wall, the part of the second AP antenna is installed behind the second wall surface of the wall adjacent the protruding corner of the wall, the first wall surface and the second wall surface forming an angle at the protruding corner of the wall.

11. The antenna system as claimed in claim 10, further comprising a power divider installed in the wall between the first and second AP antenna and the AP, the power divider providing a signal received from the AP to the first and second AP antennae, respectively.

12. The antenna system as claimed in claim 10, wherein the first AP antenna and the AP are combined and installed in the wall.

13. An antenna system for indoor wireless communications, comprising:

a first antenna structure that is installed to pass through a selected wall having a thickness in a building construction, the first antenna structure having a sliding structure that may be adjusted according to the thickness of the wall; and an AP (RF unit) connected to the first antenna structure.

14. The antenna system as claimed in claim 13, wherein the first antenna structure comprises:

first and second horn antennae which are exposed at both sides of the wall and parallel with the wall;

a feed that transmits a signal received from the AP to the first and second horn antennae; and a sliding waveguide wall that connects the first and second horn antennae and the feed in a sliding structure to match the thickness of the wall.

15. The antenna system as claimed in claim 14, wherein the AP is connected to the feed through the wall.

16. The antenna system as claimed in claim 13, wherein the selected wall comprises a first wall surface and a second wall surface, the first wall surface having the first antenna structure installed therein and the second wall surface being perpendicular to the first wall surface.

17. The antenna system as claimed in claim 16, further comprising a second antenna structure installed in the second wall surface, the second antenna structure having the same structure as the first antenna structure.

18. An antenna system for indoor wireless communications, comprising:

an access point (AP) antenna having a radio wave emitting surface, a part of the AP antenna being installed behind a wall surface of a wall in a building construction; and an AP (RF unit) electrically connected to the AP antenna.

19. The antenna system as claimed in claim 18 wherein the AP antenna and the AP are combined and installed in the wall.

* * * * *